US010495352B2

(12) United States Patent
Barclay et al.

(10) Patent No.: US 10,495,352 B2
(45) Date of Patent: Dec. 3, 2019

(54) REFRIGERATION SYSTEM INCLUDING MICRO COMPRESSOR-EXPANDER THERMAL UNITS

(71) Applicant: EMERALD ENERGY NW, LLC, Bothell, WA (US)

(72) Inventors: John A. Barclay, Bothell, WA (US); Lucian G. Ferguson, Everett, WA (US)

(73) Assignee: EMERALD ENERGY NW, LLC, Bothell, WA (US)

( * ) Notice: Subject to any disclaimer, the term of this patent is extended or adjusted under 35 U.S.C. 154(b) by 56 days.

(21) Appl. No.: 15/655,708

(22) Filed: Jul. 20, 2017

(65) Prior Publication Data

US 2017/0328603 A1 Nov. 16, 2017

Related U.S. Application Data

(62) Division of application No. 15/249,224, filed on Aug. 26, 2016, now Pat. No. 9,746,211.

(60) Provisional application No. 62/210,367, filed on Aug. 26, 2015.

(51) Int. Cl.
*F25B 9/00* (2006.01)
*F04B 35/04* (2006.01)
(Continued)

(52) U.S. Cl.
CPC ..... *F25B 9/002* (2013.01); *F04B 35/04* (2013.01); *F04C 9/007* (2013.01); *F04C 21/007* (2013.01);
(Continued)

(58) Field of Classification Search
CPC .... F25B 1/02; F25B 31/023; F25B 2309/001; F25B 2400/073
See application file for complete search history.

(56) References Cited

U.S. PATENT DOCUMENTS 4,488,477 A 12/1984 Miyamoto
4,498,296 A * 2/1985 Dijkstra ..... F02G 1/05 60/520
(Continued)

OTHER PUBLICATIONS

R. F. Barron, "Cryogenic Systems"; 2nd Edition (Oxford University Press, 1985).
(Continued)

*Primary Examiner* — Tareq Alosh
(74) *Attorney, Agent, or Firm* — Christopher A. Wiklof; Nicholas S. Bromer; Launchpad IP, Inc.

(57) ABSTRACT

An active gas regenerative refrigerator includes a plurality of compressor-expander units, each having a hermetic cylinder with a drive piston configured to be driven reciprocally therein, and a quantity of working fluid in each end of the cylinder. A piston seal in a central portion of the cylinder prevents passage of the working fluid between ends of the cylinder. Movement of the piston to a first extreme results in radial compression of one of the quantities of working fluid in a cylindrical gap formed between one end of the piston and an inner surface of the cylinder, while the other quantity is expanded in the opposite end of the cylinder. The piston includes a plurality of magnets arranged in pairs, with magnets of each pair positioned with like-poles facing each other. A piston drive is configured to couple with transverse magnetic flux regions formed by the magnets.

23 Claims, 8 Drawing Sheets

(51) Int. Cl.

| | |
|---|---|
| ***F04C 21/00*** | (2006.01) |
| ***F25B 9/06*** | (2006.01) |
| ***F25J 1/02*** | (2006.01) |
| ***F04C 9/00*** | (2006.01) |
| ***F25J 1/00*** | (2006.01) |

(52) U.S. Cl.
CPC ..... *F25B 9/06* (2013.01); *F25J 1/001* (2013.01); *F25J 1/0007* (2013.01); *F25J 1/0022* (2013.01); *F25J 1/0225* (2013.01); *F04B 2203/0403* (2013.01); *F25B 2309/001* (2013.01); *F25B 2309/002* (2013.01); *F25B 2400/073* (2013.01); *F25B 2500/01* (2013.01); *F25J 2270/908* (2013.01)

(56) References Cited

U.S. PATENT DOCUMENTS

| | | | | |
|---|---|---|---|---|
| 4,894,996 | A * | 1/1990 | Kazumoto | F02G 1/053 60/520 |
| 5,152,147 | A | 10/1992 | Saho et al. | |
| 5,309,716 | A | 5/1994 | Kolbinger | |
| 5,737,924 | A | 4/1998 | Tagauchi et al. | |
| 6,138,459 | A | 10/2000 | Yatsuzuka et al. | |
| 6,233,947 | B1 | 5/2001 | Madni et al. | |
| 6,272,866 | B1 | 8/2001 | Tsai et al. | |
| 6,326,706 | B1 | 12/2001 | Zhang | |
| 6,332,323 | B1 | 12/2001 | Reid et al. | |
| 6,462,439 | B1 | 10/2002 | Denne | |
| 8,449,274 | B1 * | 5/2013 | Zelechonok | F04B 17/04 417/246 |
| 8,587,163 | B2 | 11/2013 | Camacho | |
| 2008/0016907 | A1 | 1/2008 | Barclay et al. | |
| 2008/0115664 | A1 | 5/2008 | Minowa et al. | |
| 2015/0004028 | A1 | 1/2015 | Kang et al. | |

OTHER PUBLICATIONS

J. A. Barclay, M. A. Barclay, W. Jakobsen, and M. P. Skrzypkowski, NASA SBIR Phase I Final Report, 2004; "Active Gas Regenerative Liquefier"; Contract No. NNJ04JC25C.

* cited by examiner

REFRIGERATION SYSTEM INCLUDING MICRO COMPRESSOR-EXPANDER THERMAL UNITS

CROSS-REFERENCE TO RELATED APPLICATIONS

The present application is a U.S. Divisional application of co-pending U.S. patent application Ser. No. 15/249,224, entitled "REFRIGERATION SYSTEM INCLUDING MICRO COMPRESSOR-EXPANDER THERMAL UNITS," filed Aug. 26, 2016; which application claims priority benefit from U.S. Provisional Patent Application No. 62/210,367, entitled "WORK MECHANISMS FOR DIRECTLY-COUPLED MICRO COMPRESSOR-EXPANDER THERMAL UNITS," filed Aug. 26, 2015; each of which, to the extent not inconsistent with the disclosure herein, is incorporated herein by reference.

BACKGROUND

Refrigeration and liquefaction cycles with gas as the working fluid and sometimes also the process gas have been known since about 1900 and are well described in the technical literature. Essentially all of the these cycles operate on the principle of compressing a working gas, transferring the heat of compression to a heat sink, cooling the gas in a recuperative or regenerative heat exchanger, further cooling of the gas via either isenthalpic or isentropic expansion, transferring a thermal load into the working gas from a heat source, warming the lower pressure gas back to near the temperature of the compressor, and repeating the cycle. In cycles such as the Linde cycle, the cooled high-pressure gas is expanded isenthalphically in a Joule-Thomson valve with no work recovery. Cycles with no work recovery generally have low thermodynamic efficiency relative to the minimum work required to pump heat from a colder source to a warmer heat sink. The primary reason for such low efficiency is a fundamental limitation of poor heat transfer during rapid compression of a gas; rather than being isothermal, the process is adiabatic or nearly so via polytropic compression. This inefficiency causes significantly more work input per unit mass flow than the ideal isothermal process. Without recovery of any of this work input during a refrigeration cycle, the ratio of the cooling power to the rate of work input is much lower than the ideal ratio, i.e., low relative thermodynamic efficiency (e.g., a few percent out of 100%).

To improve refrigerator efficiency, gas expanders were invented whereby precooled high-pressure working gas is expanded isentropically from higher pressure to lower pressure with corresponding work production plus larger cooling effect. In refrigeration cycles that recover work of expansion to offset some input work of compression, the thermodynamic efficiency increases. Tagauchi et al. in U.S. Pat. No. 5,737,924 and Saho et al. in U.S. Pat. No. 5,152,147 describe use of regeneration to help recover some of the thermal energy of expansion of a portion of the working gas stream. Kolbinger describes an assembly of two rotary engines to form a compressor-expander with no discussion of recovery of work in U.S. Pat. No. 5,309,716. An electromagnetic apparatus to produce linear motion in a macro-structure device is described by Denne in U.S. Pat. No. 6,462,439, and a micro electro-mechanical system for providing cooling with compression and expansion spaces separated by a regenerator in a Stirling cycle without direct work recovery is described by Tsai et al. in U.S. Pat. No. 6,272,866. An array of refrigeration elements is disclosed by Reid et al., in U.S. Pat. No. 6,332,323. The refrigeration elements are combined to form a highly efficient active gas regenerative refrigerator. Refrigeration elements configured into an appropriate array of dual opposing thermal regenerators in an active regenerative refrigerator simultaneously enable the feature to alternatively provide active heating or cooling to reciprocating heat transfer fluid that flows over the outside surfaces of the refrigeration elements. The active heating or cooling in the opposite ends of small hermetic refrigeration elements can be caused by driving a sealed piston back and forth in each refrigeration element. The drive mechanisms contemplated in the '323 patent are by electromagnetic, pneumatic, or other means, but few details are given. The array of refrigeration elements is configured to enable reciprocating heat transfer fluid motion, as in conventional passive regenerators in regenerative cycle refrigerators such as the Stirling, Gifford McMahon, or pulse-tube cryocoolers, but in active regenerative refrigerator, the heat transfer fluid is separate from the working fluid, and the heat transfer fluid is not compressed or expanded during its cycle, other than as required for flow through the refrigeration element array and external heat exchanger.

A small proof-of-concept active gas regenerative refrigerator was successfully built and initially tested with the support of a NASA Phase I small business innovation research SBIR award (J. A. Barclay, M. A. Barclay, W. Jakobsen, and M. P. Skrzypkowski, NASA SBIR Phase I Final Report, 2004; "Active Gas Regenerative Liquefier"; Contract No. NNJ04JC25C). Approximately 200 identical small stainless steel tubes were assembled into a rectangular array of tubes, each with a micro-regenerator and a common pressure wave means for all tubes in parallel. Initial results from the first lab prototype proved the active end of the tubes did heat and cool upon compression or expansion, respectively, and that the active gas regenerative concept was valid.

SUMMARY

Embodiments relate to methods and apparatuses for work input with simultaneous work recovery in a refrigeration cycle by nearly isothermal polytropic compression and synchronous nearly isothermal polytropic expansion of a working gas. Embodiments of the invention relate to a basic thermal unit of an efficient refrigerator and more particularly to active gas regenerative refrigerators utilizing an array of directly coupled micro compressor-expander units (MCEUs) with electromagnetic or pneumatic mechanisms for producing linear reciprocating motion of a piston to cause simultaneous heating or cooling by compression and expansion of a working gas within the basic thermal unit. Embodiments generally relate to fabrication of apparatuses and methods to enable work input into each micro gas compressor region coupled with simultaneous work recovery from the micro gas expander region. The combined effect of a high-performance regenerator array of micro compressor-expander units creates an efficient active gas regenerative refrigeration cycle for transferring heat from a colder thermal source to a hotter thermal sink for numerous refrigeration applications including liquefying natural gas, hydrogen, helium or other gases.

Various embodiments provide work recovery of compression of an equal amount of working gas on one end of a MCEU tube by a common drive piston by simultaneous expansion of an equal amount of working gas on the opposite end of the common drive piston. The net driving force to move the piston alternatively inside the MCEU tube is provided by arrangements of permanent magnets and drive coils, in one embodiment of the invention.

According to an embodiment, the length of thermally active sections at each end of a MCEU remains constant by using radial compression and expansion of a helium (He) working gas. This overcomes limitations of previous designs that used bellows or axial movement of the working gas with changes in the geometry of thermally active regions of the MCEU during its operation.

According to an embodiment, radial motion of helium gas keeps a mass of He working gas constant in each thermally active section during the MCEU cycle. This overcomes one of the disadvantages of the NASA SBIR proof-of-principle prototype referenced above, of having different thermal mass in the thermally active sections at opposite ends of a MCEU by moving more or less working helium gas into or out of each MCEU during compression and expansion steps, respectively.

According to an embodiment, the Biot number of a He working gas and tube walls of a MCEU (e.g. 0.125" outer diameter Al alloy 2024 T6 tubes with 0.003" wall) is $\sim 10^{-3}$, so tube walls in thermally active sections of the MCEU change temperature almost synchronously with the He working gas during a nominal 1 Hz cycle. The tube walls become part of the active thermal mass of each MCEU during an active gas regenerative refrigeration cycle.

According to an embodiment, a drive piston of a MCEU has two or more sets of small opposing $Nd_2Fe_{14}B$ magnets that create two or more concentrated transverse magnetic flux regions perpendicular to the axis of a center section of the MCEU tube. The MCEU also includes a thin, electrically-energizable coil around the outside of the center section of the MCEU. This arrangement significantly increases the Lorenz force on the drive piston from a magnetic field generated by the coil.

According to an embodiment, a piston of a MCEU has two or more sets of small opposing $Nd_2Fe_{14}B$ magnets that create two or more concentrated transverse magnetic flux regions perpendicular to the axis of a center section of the MCEU tube. The MCEU also includes a thin, annular, cylindrically-shaped permanent magnet array which is closely fitted with low-friction seals inside a hermetic tubular enclosure around the center section of the MCEU. This annular permanent magnet array is pneumatically driven back and forth by pressurized gases such as $N_2$ or $H_e$, alternatively supplied to drive chambers defined in part by the tubular enclosure, via small tubes from a separate gas-supply subsystem. The transverse flux of the permanent magnets within the drive piston couples strongly with the cylindrically-shaped permanent magnet array. The strong magnetic flux coupling between the opposing magnets in the annular drive array and the magnets of the drive piston cause the drive piston to reciprocally move with the annular permanent magnet array, which simultaneously compresses and expands the working gas at respective ends of the piston during MCEU operation.

According to an embodiment, a hoop stress of thin-walled tubes of a MCEU array during maximum compression of a He working gas is only about ½ of the yield strength of MCEU tube materials such as Al 2024-T6. This enables good dimensional stability and good sealing in the MCEU.

According to an embodiment, a MCEU design enables work recovery from expansion of working gas at one end of the MCEU to offset work input to compress the working gas on an opposite end of the MCEU.

According to an embodiment, a magnetic drive is provided, including a hermetic pneumatic shell containing thin, cylindrical annular permanent magnets around the outer shell wall of a center section of a MCEU tube. The tube contains two or more sets of opposing permanent magnets in an axially moveable compressor/expander piston assembly within the MCEU, which increases the transverse magnetic flux and thereby increases the magnetic coupling between the permanent magnets in the piston and those in the pneumatic drive.

According to an embodiment, the work required for a cycle of a MCEU array is distributed over a wide range of temperatures near the operating temperature of each MCEU of the array, rather than input in a lumped fashion as through a compressor in most conventional gas cycle refrigerators and liquefiers.

According to an embodiment, electronic control of each MCEU of an array is provided, so the performance of an overall active regenerator that includes the array of MCEUs can be fine-tuned during cool-down, to permit compensation for variations in thermal loads from a process stream, to accommodate o-p conversion for hydrogen, and to compensate for performance degradation during long term operation. The hermetic nature of each MCEU provides highly reliable operation.

According to an embodiment, entropy changes required for heat flows in a dual-regenerator design of an active gas regenerative refrigerator (AGRR) come from simultaneous compression and expansion of working gas in each MCEU of an array. Heat flow through the dual regenerators on opposite thermally active ends of the array of MCEUs comes from the coupling of individual MCEUs of the array via a reciprocating flow of heat transfer fluid. The thermodynamic cycle of each MCEU is distinct, consisting of a polytropic compression and associated temperature increase, heat transfer to the heat transfer fluid with a corresponding small temperature and pressure decrease of the compressed working gas inside the MCEU, a polytropic expansion with an associated temperature decrease, and heat transfer from the heat transfer fluid with a corresponding small temperature and pressure increase in the expanded working gas. This combination of events creates a small unique thermodynamic cycle for each MCEU with corresponding heat flows at mean temperatures, $T_H$ and $T_C$, and associated work input.

According to an embodiment, there is a recovery of compression work by direct coupling to an expansion at a slightly lower temperature in this cycle. If the heat transfer fluid through the dual regenerators is shut off, the net work input into a MCEU will drop to zero even though the working gas is being compressed and expanded on opposite ends of the MCEU (excluding frictional dissipation in the seal and Joule heating in the drive coils). This feature is difficult to do effectively in conventional gas cycle refrigerators and is one of the reasons that gross efficiencies of conventional gas refrigerators are so low relative to ideal. Turbo-expander units have been built for cryogenic Claude cycle refrigerators but the amount of work recovery is generally relatively small because the gas expansion is done at a temperature substantially different from the gas compression. Intrinsic work recovery to the extent allowed by a thermodynamic refrigeration cycle is one of the reasons that active gas regenerative refrigerators show promise of high efficiency. This is caused by the synchronous force balance in each MCEU. This very desirable feature is enabled by directly coupling the compression of the working gas at one end of each MCEU with the simultaneous expansion of the working gas at the other end of the same MCEU in identical dual regenerators. Accomplishing this coupling allows efficient distributed work input and work recovery from near ambient temperature to cryogenic temperatures as low as ~4 K. By using this novel concept the net required work input for a given thermal load is reduced substantially no matter what the temperature span of the refrigerator or liquefier is. To the knowledge of the inventors, this input of "distributed net work" is unique among gas refrigerators.

According to an embodiment, the thermal mass of each active end of a MCEU of an array in dual regenerators are similar and provide the desirable feature of thermally-balanced regenerators, even with heat capacity variations of tubing material, piston material, drive mechanism, and working gas as a function of temperature.

DETAILED DESCRIPTION

Figure 1A:
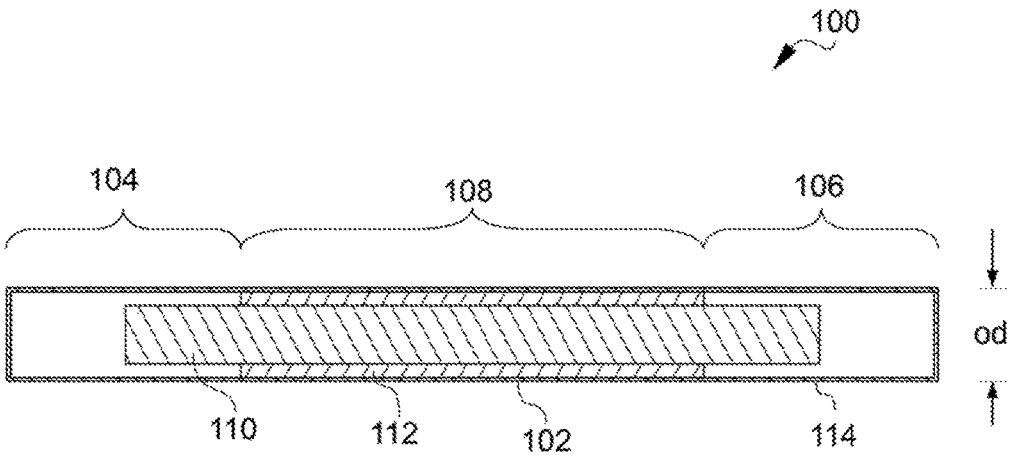
FIGS. 1A and 1B illustrate the basic structure of a micro compressor-expander unit (MCEU), according to an embodiment, with a moveable drive piston coupling compression and expansion of a working gas in opposite end sections of the MCEU, with the piston in, respectively, a neutral position and a position at one extreme of movement.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

During the NASA SBIR project referred to above, several challenging design issues were identified which were beyond the scope of the project. Most of these issues were related to manufacturing individual refrigeration elements, each with means to synchronously drive reciprocating micro pistons in each element when the working helium gas is at sufficiently high pressures (several MPa), and at pressure ratios large enough to cause polytropic temperature changes of between 2 K and 20 K during compression or expansion. The electromagnetic-magnetic drive forces in the initial drive designs were small compared to the pressure forces on the piston from the He gas at the peak pressures in the MCEU cycle. These issues are reduced or overcome by various embodiments of the present invention.

Figure 1B:
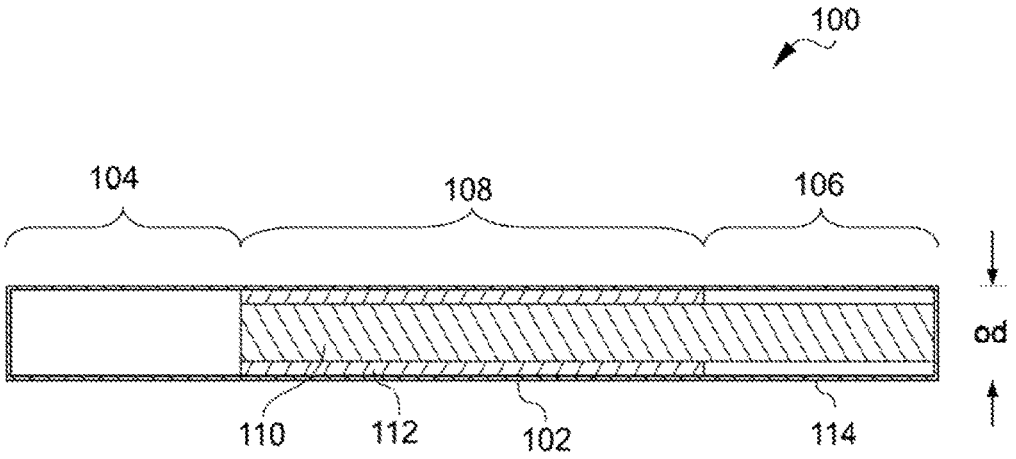

A simple version of a single micro compressor-expander unit (MCEU) tube 100, according to an embodiment, is illustrated in FIGS. 1A and 1B, including a uniform cylindrical metal tube 102 formed into a hermetic thin shell with good mechanical strength, modest thermal mass, and reasonable thermal conductivity. This MECU has three sections; two "thermally active" end sections 104, 106 and a thermally static center section 108. A moveable piston 110 at equilibrium in the center section of the MCEU tube 100 has an electromagnetic or pneumatic drive sufficiently strong to overcome the pressure forces on the piston 110. A stationary close-fitting, low-friction labyrinth seal 112 keeps the working gas in both thermally active ends 104, 106 of the MCEU tube 100 during a compression-dwell-expansion-dwell cycle. Working gas in the active sections 104, 106 of the MCEU tube 100 simultaneously executes the same thermodynamic cycle, but exactly out of phase with the cycle of the working gas at the opposite end of the MCEU tube 100. The working gas can be any of a number of different gases, including, for example, helium (He). The thermally active sections 104, 106 in a highly efficient active gas regenerator need high specific area so the tube diameter (od) will be small (specific area for a cylindrical tube is 4/(tube od) or ~1,200 $m^2/m^3$ for a ⅛" od tube).

In FIG. 1A the piston 110 is in its equilibrium position and the pressure of the working gas is the same in both end sections 104, 106 of the MCEU tube 100. In FIG. 1B the piston 110 is in its right-most position, with compressed, hotter helium working gas also on the right end 106 of the MCEU tube 100, and expanded, colder helium working gas on the left end 104 of the tube 100 (the polytropic temperature changes depend on several MCEU design variables and can be ~2 K to ~20 K). According to an embodiment, an enhanced piston design has several components; both ends of the piston 110 that extend into the thermally active sections 104, 106 of the MCEU tube 100 are made from material with reasonably high mechanical strength, low thermal mass, and poor thermal conductivity. As described in detail below with reference to FIGS. 6 and 7, the central part of the moveable piston 110 contains several opposing pairs of high-strength, small, cylindrically-shaped, permanent magnets held in a thin tubular structure that moves within a thin tube of material that has a low friction coefficient (e.g. loaded Teflon or Rulon) bonded to the inner wall of the center section 108 of the MCEU tube 100. The piston's mechanical properties enable a low-leakage, low-friction labyrinth seal 112 as the piston 110 is driven between opposite ends of the MCEU tube 100 by electromagnetic or pneumatic means.

According to an embodiment, the thermally active regions of the MCEU tube 100 enable the execution of an active gas regenerative cycle in the thermally active sections 104, 106 of the MCEU tube 100. This cycle executed half a cycle out of phase at opposite active ends of the MCEU tube 100 consists of four steps; i) a polytropic compression with no transverse flow of a separate heat transfer fluid (HTF); ii) an isochoric (constant volume) step with cold-to-hot flow of HTF that causes the temperature and pressure of the compressed He working gas and the shell wall 114 in one end of the MCEU tube 100 to decrease by the temperature increase of the compressed end of the MCEU tube 100 while the HTF is heated; iii) a polytropic expansion with no HTF flow; and iv) an isochoric step with hot-to-cold flow of HTF that causes the temperature and pressure of the expanded He working gas in the same end of the MCEU tube 100 and the shell wall 114 in the thermally active regions 104, 106 of the MCEU tube 100 to increase while the HTF is cooled.

The resultant force on the piston 110 in each MCEU tube 100 comes from the differential pressures in the opposite end sections of the MCEU tube 100 pushing on the end area of the piston 110. The cooling power of each MCEU tube 100, the rejected heat rate, and the net work rate required to move the piston 110 in each polytropic compression step of the MCEU cycle are a function of several design variables such as the mean MCEU operating temperature, temperature span, mean loading pressure of He working gas, diameter and wall thickness of the tube 100, the pressure ratio and corresponding polytropic temperature changes, etc. For example, in a system configured for liquefying natural gas, the polytropic exponent k changes from ~1.04 at 290 K to ~1.1 at 110 K (He alone has a value of 1.66). The inventors' calculations indicate excellent promise for fabrication of small-diameter, tubular, inexpensive MCEUs driven either electromagnetically, at lower temperatures, or pneumatically, at higher temperatures, such as may enable very efficient active gas regenerative refrigerators (AGRRs) and active gas regenerative liquefiers (AGRLs) to be built.

The cylindrical hermetic MCEU tube 100 illustrated in FIGS. 1A and 1B includes many basic elements, according to an embodiment. The detailed MCEU cycle analysis presented below allows calculation of heat flows, work flows, pressures, temperatures, material property changes as a function of temperature, and forces for a wide range of design variables. The further description that follows gives a detailed explanation of the MCEU cycle and work input mechanisms to drive the piston 110 as it simultaneously compresses and expands the working gas.

To better explain the non-obviousness and usefulness of the MCEU, an analysis is provided of a regenerative refrigeration cycle when an array of MCEUs is combined, in accordance with an embodiment of an active gas regenerative refrigerator (AGRR). The working gas cycle in each end section 104, 106 of a MCEU tube 100 consists of four steps; i) a polytropic compression by moving the piston 110 to the right with no transverse heat transfer fluid (HTF) flow of the AGRR; ii) an isochoric (constant volume) step with cold-to-hot flow of HTF around the MCEUs with thermal energy transfer from the MCEUs to the HTF, thereby decreasing the temperature and pressure of the He working gas in hermetic MCEU tubes 100 as the HTF is heated; iii) a polytropic expansion of the working gas in the MECUs by moving the piston 110 to the left with no HTF flow; and iv) an isochoric step with hot-to-cold flow of HTF that causes the temperature and pressure of the He working gas in the MCEU tubes 100 to increase as the HTF is cooled. It is important to note that the working gas in the other end section of the MCEU tube 100 simultaneously executes exactly the opposite cycle.

The performance of the thermodynamic cycle executed by the working gas at each end 104, 106 of the MCEU tube 100 is calculated for an ideal gas at constant temperature near room temperature, and then with real gas properties in a MCEU with realistic design specifications for an AGRR operating from near room temperature to cryogenic temperatures applicable for numerous applications.

For the thermodynamic analysis the variables are defined as follows:

$T_w$—tube wall temperature
$T_g$—working gas temperature
$m_g$—mass of working gas in both ends of the tube
$\mu_g$—molar mass of gas
$m_w$—tube wall mass
n—number of moles of working gas
$c_v$, $c_p$—molar heat capacities of the working gas
$c_w$—heat capacity of tube material per unit mass
R—universal gas constant, R=8.314 J/(mol K)

Consider a control volume around one thermally active end section 104, 106 of the MCEU tube 100 including the working gas hermetically contained inside a thin-walled tubular shell. Apply energy conservation to the ideal working gas during the cycle and the shell and assume adiabatic processes, i.e., dQ=0 for control volume which can be expressed as:

$$m_w c_w dT_w = -dU_g - pdV$$

Assume instantaneous heat transfer from the working gas to the shell wall 114 associated with a very small Biot number which means:

$$dT_w = dT_g = dT$$

The derivation of relationships between p, T and V are:

$$dU_g = nc_V dT,$$

$$n = \frac{m_g}{\mu_g}$$

$$m_w c_w dT = -nc_V dT - pdV$$

$$(m_w c_w + nc_V)dT = -pdV$$

Given the ideal gas equation of state is:

$$pV = nRT$$

$$-pdV = -nRdT + Vdp$$

After substituting for dT into the first-law equation we have:

$$(m_w c_w + nc_V + nR)pdV = -(m_w c_w + nc_V)Vd\,p$$

$$\frac{(m_w c_w + nc_V + nR)}{(m_w c_w + nc_V)}\frac{dV}{V} = -\frac{dp}{p}$$

$$\frac{(m_w c_w + nc_V + nR)}{(m_w c_w + nc_V)}\ln(V) = -\ln(p) + \ln(const)$$

$$pV\frac{(m_w c_w + nc_V + nR)}{(m_w c_w + nc_V)} = const$$

$$\gamma = \frac{c_p}{c_V} \quad c_p - c_V = R = 8.3144\frac{J}{\text{mol}\,K}$$

$$k = \frac{(m_w c_w + nc_V + nR)}{(m_w c_w + nc_V)} = \frac{\frac{m_w}{n}c_w + c_V + R}{\frac{m_w}{n}c_w + c_V} = \frac{\frac{m_w}{n}c_w + c_p}{\frac{m_w}{n}c_w + c_V} = \frac{c_p^a}{c_V^a}$$

This equation defines k as the polytropic compression or expansion exponent. In the limit of massless tube walls, it reduces to $c_p/c_v$ for the working gas as expected.

$$pV^k = const$$

or $$p_2 - p_1\left(\frac{V_1}{V_2}\right)^k$$

and $$T_2 = T_1\left(\frac{V_1}{V_2}\right)^{k-1}$$

The polytropic exponent, k, and the compression ratios of working gas in the MCEU show the importance of the ratio of thermal mass of the He working gas and the walls of the tube 102 (the drive piston 110 can be selected to minimize its thermal mass), the mean pressure of the He gas in the MCEU, and the geometry of the MCEU design. This derivation also shows that an adiabatic process for the entire control volume at either end 104, 106 of the MCEU tube 100 means a polytropic process for the working gas during the compression or expansion caused by the moveable piston 110.

The specific work per mole for the working gas in a non-flow, hermetic MCEU is:

$$w_{polytropic,nonflow} = \frac{-RT_1}{k-1}\left[\left(\frac{p_2}{p_1}\right)^{\frac{k-1}{k}} - 1\right] = c_V(T_1 - T_2)$$

The work of compression for a polytropic process is then:

$$W_{polytropic,nonflow} = \frac{-nRT_1}{k-1}\left[\left(\frac{p_2}{p_1}\right)^{\frac{k-1}{k}} - 1\right]$$

Define $$r = \frac{V_1}{V_2} > 1,$$

so the work of compression done on the working gas becomes:

$$W_{polytropic} = \frac{nRT_1}{k-1}[r^{k-1} - 1]$$

If no HTF flows in the regenerator of the AGRR, the temperature $T_2$ of the helium working gas in the MCEUs does not change after polytropic compression so the working gas upon polytropic expansion returns exactly to $T_1$. This is exactly what is expected in an ideal working gas with instantaneous heat transfer, no friction or leakage in the drive piston 110, no thermal conduction along shell walls 114, and perfect insulation between the working gas and the drive piston 110.

Now consider what happens when HTF flows over/around the MCEUs in the respective regenerator arrays to change $T_2$ to $T_3$ before the polytropic expansion step occurs.

$$p_2 = p_1\left(\frac{V_1}{V_2}\right)^k, \quad T_2 = T_1\left(\frac{V_1}{V_2}\right)^{k-1}, \quad p_3 = p_2\frac{T_3}{T_2},$$

Choose $$T_3 = \frac{T_1 + T_2}{2} = \frac{T_1\left(1 + \left(\frac{V_1}{V_2}\right)^{k-1}\right)}{2}$$

because the temperature approach between the HTF and the MCEU shell at that position in the regenerator of the AGRR decreases from a maximum of $T_2 - T_1$ to ~0 during the optimum flow period of the HTF (this average value of $T_3$ assumes linear temperature chance which is a reasonable choice).

$$p_3 = p_1\left(\frac{V_1}{V_2}\right)^k\frac{T_3}{T_2} = p_1\left(\frac{V_1}{V_2}\right)^k\frac{\left(1 + \left(\frac{V_1}{V_2}\right)^{k-1}\right)}{2}\left(\frac{V_1}{V_2}\right)^{1-k} = p_1\frac{\left(\frac{V_1}{V_2} + \left(\frac{V_1}{V_2}\right)^k\right)}{2}$$

$$p_4 = p_3\left(\frac{V_3}{V_4}\right)^k = p_1\frac{\left(\frac{V_1}{V_2} + \left(\frac{V_1}{V_2}\right)^k\right)}{2}\left(\frac{V_1}{V_2}\right)^{-k} = p_1\frac{\left(\frac{V_1}{V_2}\right)^{1-k} + 1}{2}$$

From isochoric cooling/heating:

$$T_4 = T_1\frac{p_4}{p_1} = T_1\frac{\left(\frac{V_1}{V_2}\right)^{1-k} + 1}{2}$$

Figure 2A:
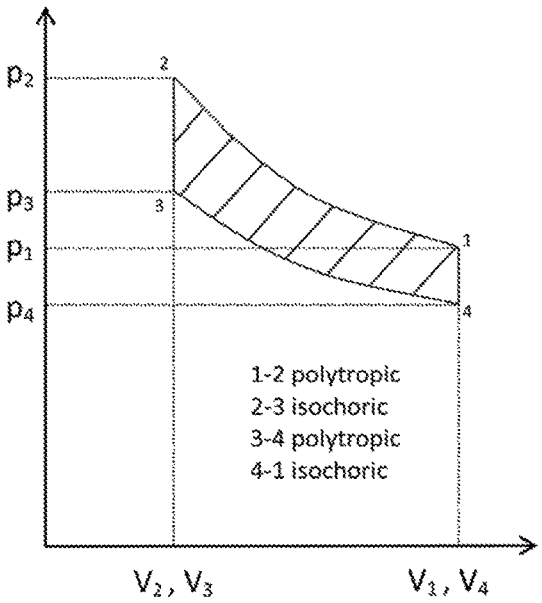
FIGS. 2A and 2B illustrate, respectively, the idealized pressure vs. volume, and pressure vs. temperature cycles of the working gas within one thermally active end section of a MCEU, according to an embodiment.
Figure 2B:
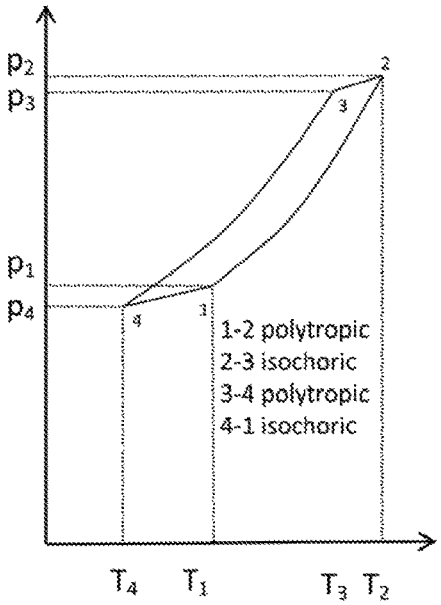

Two MCEU cycles, as illustrated in FIGS. 2A and 2B below, are simultaneously executed 180° out of phase by the same mass of working gas at each dual regenerator section at opposite end sections 104, 106 of the tube 100. The working gas changes in pressure and temperature as the piston 110 in the MCEU tube 100 is driven to one end or the other end of the MCEU tube 100. The diagrams described below illustrate the idealized cycle for the working gas in each end 104, 106 of the MCEU tube 100, as follows (mass transfer through leaky seals 112 on drive piston 110 neglected):

Calculating the temperature after polytropic expansion as a check:

$$T_4 = T_3\left(\frac{V_3}{V_4}\right)^{k-1} = \frac{T_1\left(1 + \left(\frac{V_1}{V_2}\right)^{k-1}\right)}{2}\left(\frac{V_2}{V_1}\right)^{k-1} = T_1\frac{\left(\frac{V_1}{V_2}\right)^{1-k} + 1}{2} \text{ Looks O.K.}$$

$$T_1 - T_4 = T_1 - T_1\frac{\left(\frac{V_1}{V_2}\right)^{1-k} + 1}{2} = T_1\frac{1 - \left(\frac{V_1}{V_2}\right)^{1-k}}{2} = T_1\frac{1 - r^{1-k}}{2}$$

The resultant work input needed for a complete cycle of the working gas (ideal gas) in a thermally active end section 104, 106 of the MCEU tube 100 is given by the difference between work of compression from $T_1$ and the work from expansion from $T_3$, a slightly lower temperature:

$$\Delta W_{polytropic} = W_{1-2} - W_{3-4} = \frac{nRT_1}{k-1}[r^{k-1} - 1] - \frac{nRT_4}{k-1}[r^{k-1} - 1]$$

-continued $$\Delta W_{polytropic} = W_{1-2} - W_{3-4} = \frac{nR(T_1 - T_4)}{k-1}[r^{k-1} - 1]$$

$$\Delta W_{polytropic} = W_{1-2} - W_{4-3} = \frac{nRT_1}{k-1}\frac{\lfloor r^{k-1} + r^{1-k} - 2\rfloor}{2}$$

$$x = \frac{\Delta W_{polytropic}}{W_{4-3}} = T_1\frac{\lfloor r^{k-1} + r^{1-k} - 2\rfloor}{2}\frac{1}{T_1\frac{[r^{1-k}+1]}{2}[r^{k-1}-1]} = \frac{\lfloor r^{k-1} + r^{1-k} - 2\rfloor}{r^{k-1} - r^{1-k}}$$

$$x = \frac{\Delta W_{polytropic}}{W_{4-3}} = \frac{r^{k-1} + r^{1-k} - 2}{r^{k-1} - r^{1-k}}$$

Figure 3:
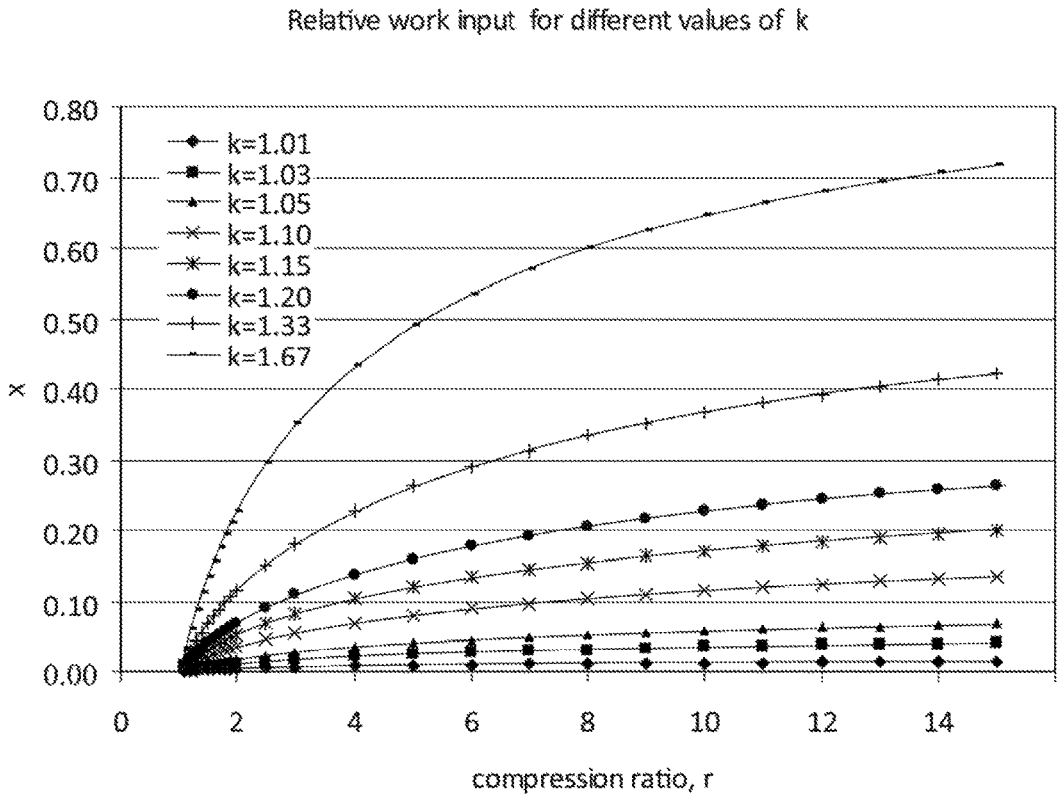
FIG. 3 illustrates the relative work input in a complete cycle for the working gas in one end section of a MCEU, according to an embodiment.

FIG. 3 illustrates the relative work input in a complete cycle for the working gas in one end section 104, 106 of a MCEU tube 100, according to an embodiment. The curves shown in FIG. 3 indicate that to make an effective MCEU cycle, the design choices must achieve k of ~1.05 to ~1.10 with a piston geometry that gives a compression ratio of ~2. Such values can be obtained with MCEU tube 100 dimensions of 0.125" o.d. with a wall thickness of 0.003" with overall length of 8" and thermally active sections 2" long with 5.0 MPa (~750 psia) mean pressure with a piston sized to give a compression ratio of ~1.2 to ~2.0 (see FIG. 1B). If k ~1 (the isothermal limit), x is close to zero no matter what the compression ratio is, i.e., there is no work recovered because no work is input and there is no cooling. This limit is approached only for very large thermal mass of the MCEU shell 114, very little working gas in the MECU tube 100, and/or a small compression ratio. These regions of design space are easy to avoid in fabricating an effective MCEU.

Figure 4:
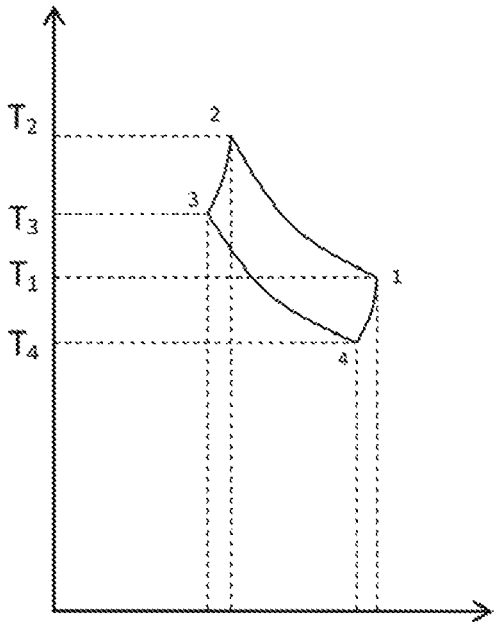
FIG. 4 illustrates the entropy-temperature diagram for the cycle of the working gas in the thermally active end sections of a MCEU, according to an embodiment.

Similarly, the heat and entropy flows for the working gas in the thermally active end sections 104, 106 of the MCEU tube 100 can be calculated. FIG. 4 illustrates the entropy-temperature diagram for the cycle of the working gas in the thermally active end sections 104, 106 of a MCEU tube 100, according to an embodiment.

In FIG. 4, the path between points 1 and 2 of the entropy-temperature diagram represents a polytropic compression of a working gas (with heat flow from the working gas to a metal shell); the path between points 2 and 3 of the entropy-temperature diagram represents isochoric cooling of the working gas from a separate heat transfer fluid; the path between points 3 and 4 of the entropy-temperature diagram represents polytropic expansion of the working gas (with heat flow from the metal shell to the working gas); and the path between points 4 and 1 of the entropy-temperature diagram represents isochoric heating of the working gas from a separate heat transfer fluid.

$$dS = \frac{C_V}{T}dT + \left(\frac{\partial p}{\partial T}\right)_V dV$$

or $$dS = \frac{C_p}{T}dT - \left(\frac{\partial V}{\partial T}\right)_p dp$$

For an ideal gas, the change in entropy is:

$$S_i - S_f = \int_i^f dS = nc_V \ln\left(\frac{T_f}{T_i}\right) + nR\ln\left(\frac{V_f}{V_i}\right)$$

-continued or $$S_i - S_f = \int_i^f dS = nc_p \ln\left(\frac{T_f}{T_i}\right) - nR\ln\left(\frac{p_f}{p_i}\right)$$

Let's define $$Q_{if} = Q_f - Q_i = \int_i^f TdS$$

For the isochoric processes in the working gas (dV=0):

$$Q_{23}=nc_V(T_3-T_2)<0,\ Q_{41}=nc_V(T_1-T_4)>0$$

These equations show that heat (thermal energy) flows out of the selected control volume of the working gas in one end section 104, 106 of a MCEU tube 100 in the hot-to-cold flow (2 to 3) of heat transfer fluid through an AGRR comprised of an array of MCEUs and heat flows into the control volume of the working gas in the cold-to-hot flow (4 to 1) of the HTF in the same AGRR.

For the polytropic processes in the working gas:

$$Q_{12} = nc_V(T_2 - T_1) + \int_1^2 TnR\frac{dV}{V} = nc_V(T_2 - T_1) + \int_1^2 \frac{T_1 V_1^{k-1}}{V^{k-1}}nR\frac{dV}{V}$$

$$Q_{12} = nc_V(T_2 - T_1) + nRT_1V_1^{k-1}\int_1^2 \frac{dV}{V^k} = nc_V(T_2 - T_1) + nRT_1V_1^{k-1}\frac{1}{1-k}(V_2^{1-k} - V_1^{1-k})$$

$$Q_{12} = nc_V(T_2 - T_1) + nRT_1\frac{1}{1-k}\left(\left(\frac{V_2}{V_1}\right)^{1-k} - 1\right) = nc_V(T_2 - T_1) + nRT_1\frac{1}{1-k}(r^{k-1} - 1) < 0$$

$$Q_{34} = nc_V(T_4 - T_3) + nRT_3\frac{1}{1-k}\left(\left(\frac{V_4}{V_3}\right)^{1-k} - 1\right) = nc_V(T_4 - T_3) + nRT_3\frac{1}{1-k}(r^{1-k} - 1)$$

Let $$Q_{12341} = Q_{12} + Q_{23} + Q_{34} + Q_{41}$$

All the $nc_V$ terms cancel each other and:

$$Q_{12341} = nRT_1\frac{1}{1-k}(r^{k-1} - 1) + nR\frac{T_1(1 + r^{k-1})}{2}\frac{1}{1-k}(r^{1-k} - 1)$$

$$Q_{12341} = \frac{nRT_1}{1-k}\left[\frac{2r^{k-1} - 2 + (1 + r^{k-1})(r^{1-k} - 1)}{2}\right] = \frac{nRT_1}{1-k}\left[\frac{r^{k-1} + r^{1-k} - 2}{2}\right]$$

This result shows that $Q_{12341}=-\Delta W_{polytropic}$, as it should be.

Figure 5:
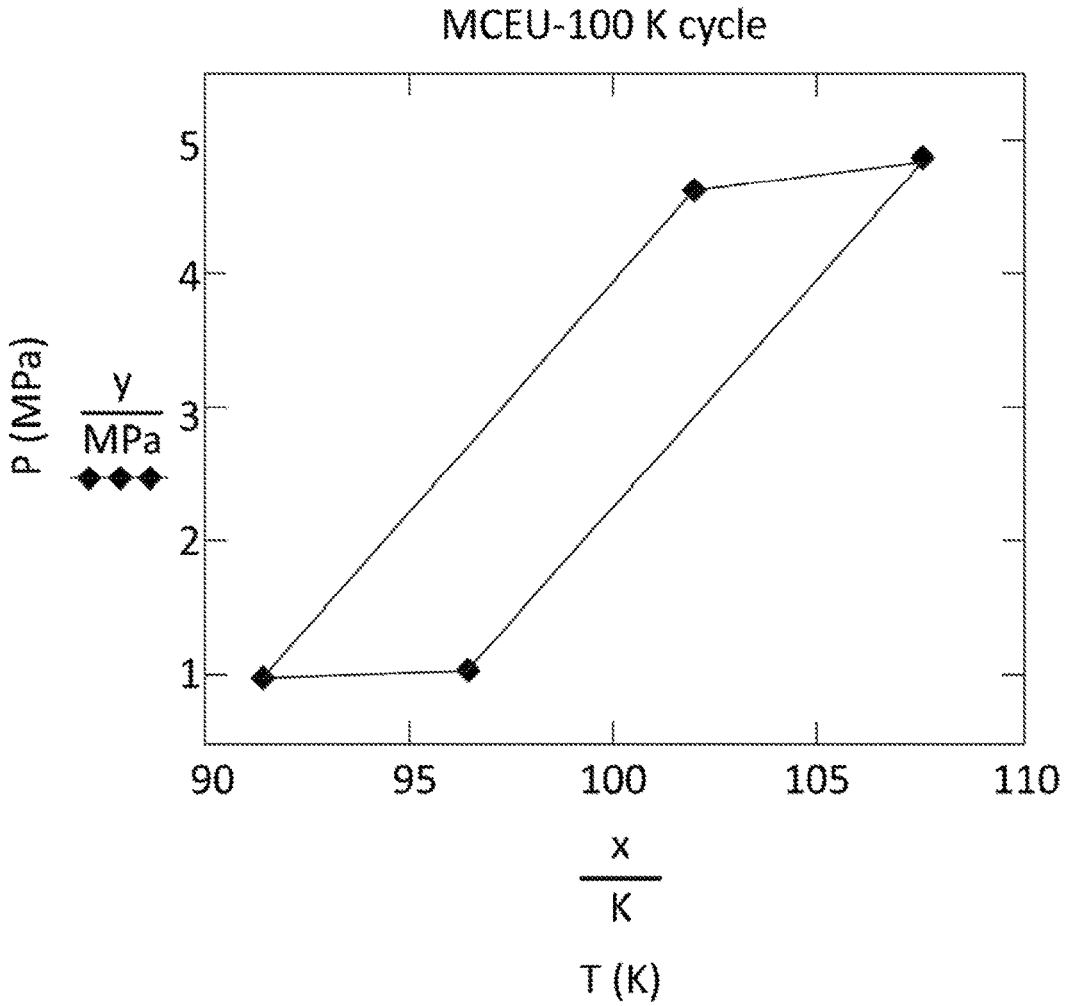
FIG. 5 shows a calculated P-T diagram for an ideal MCEU gas cycle near 100 K with instantaneous heat transfer during compression/expansion within an active gas regenerative refrigerator (AGRR) cycle, according to an embodiment.

The inventors have prepared detailed design calculations, according to an embodiment, for a new MCEU with He working gas at up to 5.0 MPa mean pressure at 290 K using ⅛" diameter Al alloy seamless tubing of type 2024-T6 with 0.003" wall thickness with pistons 110 ranging in diameter from ⅞ to ⅜ of the i.d. of the MCEU tube 100. With typical MCEU tube 100 dimensions listed above, using real gas properties for helium working gas at starting pressure of 5.0 MPa at 290 K, and the temperature-dependent heat capacity of 2024-T6 Al alloy tube material, the calculated P-T cycle for an achievable MCEU piston design with He working gas at about 100 K is shown in FIG. 5. This module could be one of three AGRRs in an efficient AGRL for liquid natural gas (LNG).

Figure 6:
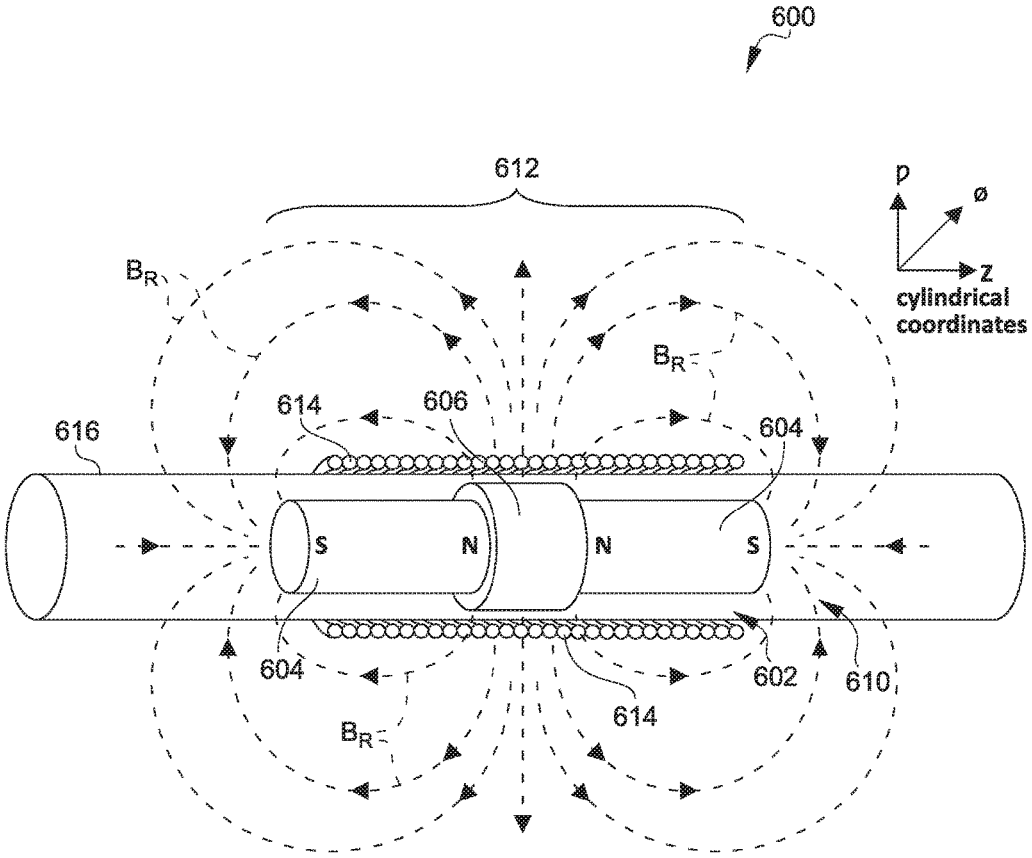
FIG. 6 illustrates details of a piston structure of a MCEU, according to an embodiment, with two sets of opposing permanent magnets, with a magnetic coupler, to create a stronger transverse flux, compared to a single permanent magnet.

FIG. 6 illustrates details of a piston structure of a MCEU tube 600, according to an embodiment, with one or more sets 602 of opposing permanent magnets 604, with a magnetic coupler 606, to create a stronger transverse flux, compared to a single permanent magnet. In one embodiment of the invention, illustrated in FIG. 6, two small-diameter cylindrical high-field $Nd_2Fe_{14}B$ permanent magnets 604, which together form one set 602, are inserted as opposing each other into a cylindrical drive piston assembly 610 within a Rulon sleeve seal (not shown) in the center section 612 of the MCEU tube 600. The N-S poles of the permanent magnets 604 are aligned as S-N-N-S. This embodiment includes an iron flux coupler 606 to help concentrate the magnetic flux of the radial magnetic field $B_R$ created by the opposing permanent magnets 604. Two or more sets 602 of such opposing permanent magnets 604 are envisioned to increase the Lorenz force applicable on the drive piston 610.

FIG. 6 also shows a drive mechanism, according to an embodiment. As an example, a thin annular coil 614 with several layers of good electrical conducting or superconducting wire such as AWG 20-30, is assembled surrounding the center section of a hermetic MCEU tube 616 with the piston, seals, and working gas in it (the complete piston and seals are not shown in detail in FIG. 6, but are shown and described elsewhere). The magnetic field from the energized coil 614 couples tightly to the concentrated magnetic flux from all sets 602 of opposing $Nd_2Fe_{14}B$ magnets 604 within the piston assembly 610. As the d.c. power supply to each MCEU drive coil 614 charges with appropriate polarity during different steps within the MCEU cycle, the current in the coil 614 creates a Lorenz force on the permanent magnets 604 to thereby move the drive piston 610 inside the MCEU 600 in either axial direction. The Lorenz force in this electromagnetic drive can be adjusted in strength by adjusting the length of the center section 612 of the MCEU tube 600 relative to the thermally active sections 104, 106 of the MCEU to keep the Joule heating from the drive coils 614 to a small parasitic heat load compared to the cooling power of the MCEU tube 600 (or vice-versa).

Figure 7:
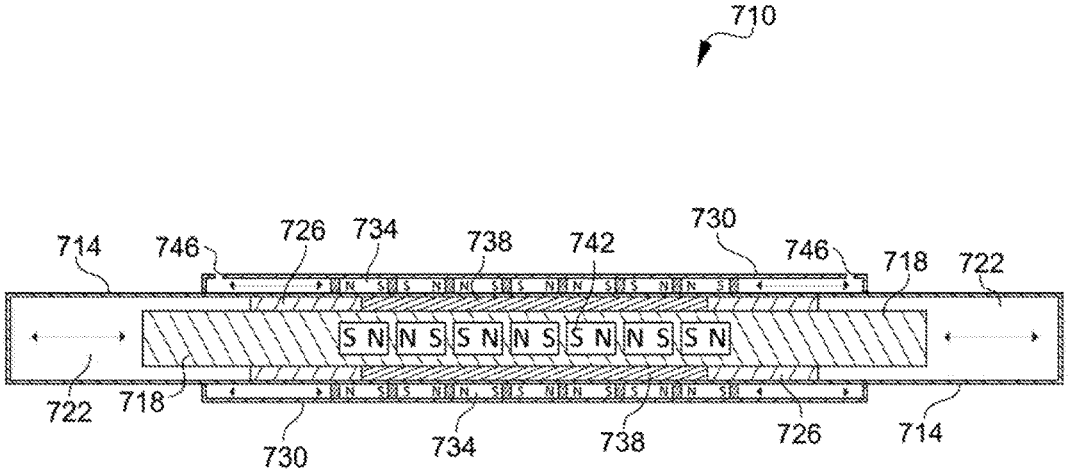
FIG. 7 shows key elements of a pneumatically-driven MCEU design, according to an embodiment, with a moveable annular permanent magnet shell around a center section of the MCEU.

In FIG. 7 an embodiment of the invention illustrates another drive mechanism for a MCEU 710. In this second embodiment of the invention two or more sets of two small-diameter cylindrical high-field $Nd_2Fe_{14}B$ permanent magnets 742 are inserted as opposing each other into a cylindrical drive piston assembly 718 within a Rulon sleeve seal 726 in the center section of the MCEU 710. A cylindrical soft iron or other high magnetic permeability material 738 is mounted in the seal section 726 of the MCEU 710 to augment coupling of the magnetic flux of the two permanent magnet arrays 734. Outside the Al tube 714 another cylindrical annular $Nd_2Fe_{14}B$ permanent magnet array 734 is mounted inside a close-fitting, low-friction hermetic tube 730 such that gas at either end of this surrounding tube 730 can change pressure to move the annular magnet array 734 back and forth. The magnetic flux from the opposing permanent magnets 742 in this shell couples tightly to the flux of similar sets of $Nd_2Fe_{14}B$ magnets 742 inside the central MCEU piston 718. This outer magnet array 734 in its close fitting housing 730 is pneumatically driven, and drives in turn the central piston inside the MCEU 710, back and forth to alternatively compress or expand its working He gas 722. One or more cylindrical, thin annular $Nd_2Fe_{14}B$ permanent magnets 734 are assembled inside a close-fitting, low-friction hermetic tube 730 surrounding the center section of the hermetic MCEU tube 710 containing the piston 718, seals 726, and working gas 722. The magnetic flux from annular permanent magnet array 734 couples tightly to the concentrated magnetic flux from all sets of opposing $Nd_2Fe_{14}B$ magnets 742 within the piston assembly 718. When the outer annular magnet array 734 in its close fitting housing 730 is pneumatically moved back and forth over the center section of the MCEU 710, it will thereby move the drive piston 718 inside the MCEU 710. The pneumatic drive in each MCEU 710 is fed by a separate pressurized gas supply (not shown) into either end of the thin hermetic shell 730 around the MCEU 710. This gas is supplied via a small tube 746 from a common feed gas source with adjustable pressures as necessary to move the annular magnet 734 back and forth. Correspondingly, the gas on the other end of the annular shell 730 around the center section of the MECU 710 will be returned to a common lower pressure vessel from which the suction port of the gas pump 746 will be fed to return higher pressure gas to the supply tank. Two-way valves on the manifolds out of the higher pressure vessel and into the lower pressure vessel of the pneumatic gas drive subsystem (not shown) allow properly-timed connections required to execute MCEU cycles via this pneumatically driven subsystem for an entire array of MCEUs (not shown).

Figure 8A:
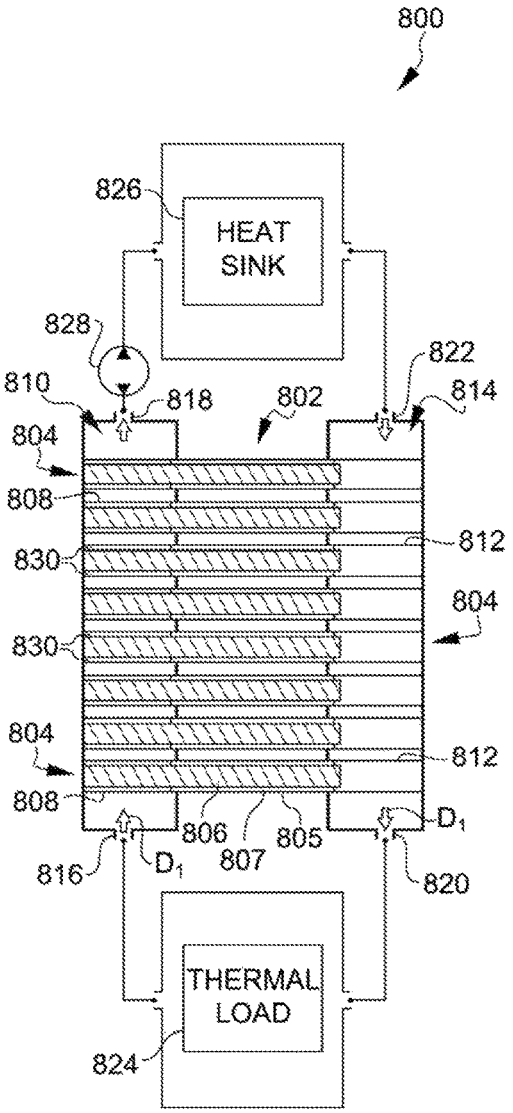
FIGS. 8A and 8B are schematic diagrams of an AGRR system showing the system during respective isochoric steps of a refrigeration cycle, according to an embodiment.
Figure 8B:
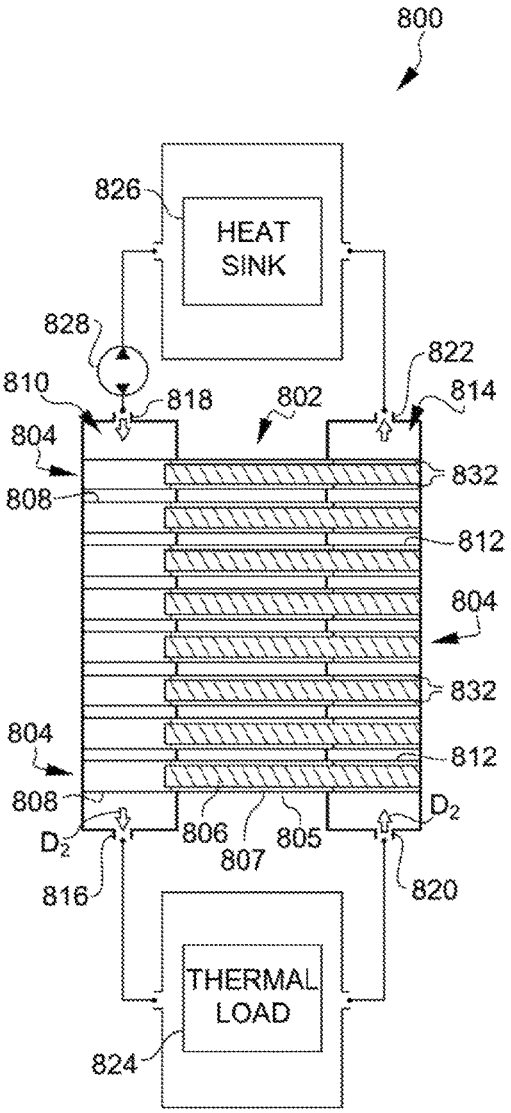

FIGS. 8A and 8B are schematic diagrams of an AGRR system 800 showing the system during respective isochoric steps of a refrigeration cycle, according to an embodiment. The AGRR system 800 includes an array 802 of MCEUs 804, each having a cylinder 805 and a double-ended drive piston 806 positioned within the cylinder 805 and configured to be driven back and forth to alternately compress and expand equal masses of working gas in respective ends of the MCEU 804. Each MCEU 804 further includes a seal 807 positioned between the inside of the cylinder 805 and the drive piston 806. The seal 807 is configured to permit axial movement of the drive piston 806 within the cylinder 805 while preventing movement of the working gas between the ends of the MCEUs 804.

The drive pistons 806 can be driven by any appropriate mechanism, such as, for example, either of the mechanisms described above with reference to FIGS. 6 and 7.

First ends 808 of each of the MCEUs 804 are positioned within a first heat transfer chamber 810, while second ends 812 of each of the MCEUs 804 are positioned within a second heat transfer chamber 814. The first heat transfer chamber 810 includes first and second fluid ports 816, 818 and the second heat transfer chamber 814 includes third and fourth fluid ports 820, 822. A thermal load 824 is in fluid communication with the first and third fluid ports 816, 820, while a heat sink 826 is in fluid communication with the second and fourth fluid ports 818, 822. A reversible fluid pump 828 is configured to drive a heat transfer fluid (HTF) through a heat transfer circuit formed by the first and second heat transfer chambers 810, 814, the thermal load 824, and the heat sink 826.

In operation, during a first operating step, the drive pistons 806 are driven to a first position, defined by an extreme of travel in a first direction, as shown in FIG. 8A, radially compressing the working gas in the first ends 808 of the MCEUs 804 into first annular gaps 830 between radial surfaces of the drive pistons 806 and inner radial surfaces of the first ends 808, while expanding the working gas in the second ends 812. This causes the temperature of the working fluid in the first ends 808 to rise, and the temperature of the working fluid in the second ends 812 to drop. During this step, the pump 828 is not in operation.

During a second step, the pump 828 operates to drive the HTF in a first direction $D_1$ through the fluid circuit, as shown in FIG. 8A, so that fluid heated by the thermal load 824 is carried into the first heat transfer chamber 810, where it is heated as it flows across the outsides of the first ends 808 of the MCEUs 804, while cooling the working fluid within the first ends 808. HTF from the first heat transfer chamber 810 is carried to the heat sink 826, where the heated fluid is cooled by contact with the heat sink 826. From the heat sink 826, the cooled HTF is carried into the second heat transfer chamber 814, where it is cooled as it flows across the outsides of the second ends 812 of the MCEUs 804, while warming the working fluid within the second ends 812. Lastly, cooled HTF is carried from the second heat transfer chamber 814 to the thermal load 824, where it efficiently chills the thermal load 824, being heated itself in return.

During a third operational step, the flow of fluid is shut down, and the drive pistons 806 are driven to a second position defined by an extreme of travel in a second direction, opposite the first direction, as shown in FIG. 8B, radially compressing the working gas in the second ends 812 of the MCEUs 804 into second annular gaps 832 between the radial surfaces of the drive pistons 806 and the inner radial surfaces of the second ends 812, while expanding the working gas in the first ends 808. This causes the temperature of the working fluid in the second ends 812 to rise, and the temperature of the working fluid in the first ends 808 to drop.

Finally, during a fourth step, the pump 828 operates to drive the HTF in a second direction $D_2$ through the fluid circuit, as shown in FIG. 8B. Accordingly, HTF is driven from the heat sink 826 to the second heat transfer chamber 814, from the second heat transfer chamber 814 to the heat sink 826, from the heat sink 826 to the first heat transfer chamber 810, and from the first heat transfer chamber 810 to the thermal load 824. The HTF cools the thermal load 824 while being heated in exchange, cools the second ends 812 of the MCEUs 804 while being heated in exchange, transfers heat to the heat sink 826, which is configured to remove the heat to a remote location, while being cooled thereby, warms the first ends 808 while being cooled, and back to the thermal load 824.

The four-step process outlined above is repeated continuously during operation of the device.

The term thermally active section is used here to refer to the outer surface of the portion of a cylinder 805 that is in direct contact, on its inner surface, with a working fluid. Because the MCEUs 804 are configured to form the first and second annular gaps 830, 832, the working fluid remains in contact with the inner surfaces of the first and second ends 808, 812 along a length of the respective cylinders 805 that remains constant throughout the operational cycle. Accordingly, the surface area of the active sections of each of the first and second ends 808, 812 of the MCEUs 804 also remains unchanged throughout the cycle, even as the respective drive pistons 806 move reciprocally within the cylinders 805. This means that the ability of the heat transfer fluid outside the MCEUs 804 to exchange heat with the working fluid inside the MCEUs 804 is not affected by the position of the pistons 806.

This is in contrast to devices in which a piston seal sweeps an inner face of a cylinder as the piston moves, compressing a working fluid into an end of the cylinder. In such a device, the active section is defined by the distance between the piston seal and the end of the cylinder, such that as the piston moves back and forth within the cylinder, the surface area of the active section continually changes, reaching a minimum when the working fluid is at maximum compression. Thus, the heat exchange capacity of the cylinder is at a minimum when the temperature difference across the cylinder wall is at a maximum, which can significantly reduce the heat transfer efficiency of the associated system.

In the embodiment of FIGS. 8A and 8B, the end surfaces of the cylinders 805 lying transverse to the cylinder axes are positioned against the walls of the first and second heat transfer chambers 810, 814 such that they are not exposed to the HTF as it flows through the chambers 810, 814. According to another embodiment, the first and second ends 808, 812 of each of the MCEUs 804 are positioned within the first and second heat transfer chambers 810, 814, respectively, and the HTF flows over and in contact with the transverse end surfaces, such that the active sections of each MCEU 804 are increased by the area of the transverse end surfaces as well. In this embodiment, the array 802 is configured such that when the drive pistons 806 of the MCEUs 804 are in either of their first or second positions, a gap remains between transverse ends of the pistons 806 and the transverse ends of the respective cylinders 805. Accordingly, working fluid remains in contact with the transverse ends of the cylinders 805 throughout the operational cycle.

The array 802 of MCEUs 804 is represented in FIGS. 8A and 8B by a small number of MCEUs 804 in a single row. It will be understood that in practice, the number of MCEUs 804 in the array can number in the hundreds, or more, and can be arranged in any appropriate configuration, including rows and columns, hexagonal grids, etc.

In the embodiment illustrated in FIGS. 8A and 8B, the AGRR system 800 is configured for use with a gaseous HTF. According to other embodiments, liquid heat transfer fluids may also be employed. It is important to avoid heat transfer fluids that might freeze during operation, which reduces the number of suitable fluids, especially liquids, particularly when the system is to be operated at cryogenic temperatures. Hydrogen and helium are among the fluids that can be employed in most cryogenic applications. According to a preferred embodiment, He gas, at a pressure of around 500 psia, is employed as the heat transfer fluid.

Although in most embodiments, a gaseous HTF is maintained at an elevated pressure of several hundred psia, in some embodiments in which the HTF is not pressurized, ambient air may be used as the HTF, in which case the heat sink 826 can be omitted, so that the air is drawn directly into one or the other heat transfer chamber, then vented back to the atmosphere after exiting the other chamber, or even after passing through the thermal load 824.

The abstract of the present disclosure is provided as a brief outline of some of the principles of the invention according to one embodiment, and is not intended as a complete or definitive description of any embodiment thereof, nor should it be relied upon to define terms used in the specification or claims. The abstract does not limit the scope of the claims. Elements of the various embodiments described above can be combined, and further modifications can be made, to provide further embodiments without deviating from the spirit and scope of the invention. All of the patents and non-patent publications referred to in this specification and/or listed in the Application Data Sheet are incorporated herein by reference, in their entirety. Aspects of the embodiments can be modified, if necessary to employ concepts of the various patents and publications to provide yet further embodiments.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. An active gas regenerative refrigerator, comprising:

a compressor-expander unit, including:

a main cylinder having first and second cylinder ends and a central cylinder region between the first and second cylinder ends;

a first quantity of working fluid positioned in the first cylinder end;

a second quantity of working fluid positioned in the second cylinder end;

a drive piston positioned inside the main cylinder and having first and second piston ends and a central piston region, the first piston end having a diameter that is less than an inside diameter of the first cylinder end such that when the drive piston is moved to a first extreme, the first mass of working fluid is compressed into a first annular gap formed between a radial surface of the first piston end and an inner radial face of the first cylinder end, the second piston end having a diameter that is less than an inside diameter of the second cylinder end such that when the drive piston is moved to a second extreme, the second mass of working fluid is compressed into a second annular gap formed between a radial surface of the second piston end and an inner radial face of the second cylinder end, wherein the drive piston includes a plurality of permanent magnets arranged in the central piston region with poles aligned axially with the drive piston and in alternating polar orientation such that adjacent magnets are positioned with like poles facing each other;

a seal comprising polytetrafluoroethylene positioned in the central cylinder region of the main cylinder between an inner face of the main cylinder and the drive piston, configured to permit the drive piston to move axially relative to the main cylinder between the first and second extremes while preventing passage of either of the first or second quantities of working fluid between the first cylinder end and the second cylinder end; and a piston drive mechanism configured to couple with the drive piston via transverse magnetic flux regions formed by the plurality of permanent magnets, wherein the piston drive mechanism includes:

an electromagnetic coil extending around the central cylinder region, the electromagnetic coil being configured to produce a magnetic field and to couple thereby with the transverse magnetic flux regions of the plurality of permanent magnets.

2. The active gas regenerative refrigerator of claim 1 wherein the main cylinder is hermetically sealed.

3. The active gas regenerative refrigerator of claim 1 wherein a mass of the first quantity of working fluid is equal to a mass of the second quantity of working fluid.

4. The active gas regenerative refrigerator of claim 1 wherein the first and second quantities of working fluid are helium.

5. The active gas regenerative refrigerator of claim 1 wherein an axial dimension of the first annular gap is equal to an axial dimension of the second annular gap.

6. The active gas regenerative refrigerator of claim 1 wherein, when the drive piston is at the first extreme, the working fluid is compressed into the first annular gap and also into a gap between a first transverse end of the drive piston and a first transverse end of the cylinder, and when the drive piston is at the second extreme, the working fluid is compressed into the second annular gap and also into a gap between a second transverse end of the drive piston and a second transverse end of the cylinder.

7. The active gas regenerative refrigerator of claim 1, wherein the electromagnetic coil is configured to create a magnetic field to couple to and drive the plurality of permanent magnets toward the first cylinder end of the main cylinder while a fluid pressure within the first cylinder end exceeds a fluid pressure within the second cylinder end, and to create a magnetic field to couple to and drive the plurality of permanent magnets toward the second cylinder end of the main cylinder while a fluid pressure within the second drive chamber exceeds a fluid pressure within the first drive chamber.

8. The active gas regenerative refrigerator of claim 1, wherein the compressor-expander unit is one of a plurality of compressor-expander units comprised by the active gas regenerative refrigerator.

9. The active gas regenerative refrigerator of claim 8, comprising:

a first heat transfer chamber, a first cylinder end of each of the plurality of compressor-expander units being positioned within the first heat transfer chamber;

a second heat transfer chamber, a second cylinder end of each of the plurality of compressor-expander units being positioned within the second heat transfer chamber;

a thermal load in fluid communication with the first and second heat transfer chambers; and a heat sink in fluid communication with the first and second heat transfer chambers, the first and second heat exchange chamber, the thermal load, and the heat sink constituting respective components of a cooling circuit configured to transfer heat from the thermal load to the heat sink.

10. The active gas regenerative refrigerator of claim 9, comprising a reversible fluid pump configured to reversibly drive a heat transfer fluid through the cooling circuit.

11. A method of operation, comprising:

compressing first quantities of working fluid into respective first annular gaps defined between radial surfaces of first ends of a plurality of drive pistons and inner radial surfaces of first ends of respective sealed cylinders of a plurality of sealed cylinders, and, simultaneously with said compressing of the first quantities of working fluid into the respective first annular gaps, expanding second quantities of working fluid positioned in respective second ends of the plurality of sealed cylinders, by moving each of the plurality of drive pistons toward the first ends of respective ones of the plurality of sealed cylinders;

transmitting thermal energy from the first quantities of working fluid in the first annular gaps to a first flow of heat transfer fluid by passing the first flow of heat transfer fluid over the first ends of the sealed cylinders, and, simultaneously with said transmitting of the thermal energy from the first quantities of working fluid in the first annular gaps, transmitting thermal energy from a second flow of heat transfer fluid to the second quantities of working fluid by passing the second flow of heat transfer fluid over the second ends of the sealed cylinders;

compressing the second quantities of working fluid into respective second annular gaps defined between second radial ends of the plurality of drive pistons and inner radial surfaces of the second ends of respective ones of the plurality of sealed cylinders, and, simultaneously with said compressing of the second quantities of working fluid into respective second cylindrical gaps, expanding the first quantities of working fluid positioned in the respective first ends of the plurality of sealed cylinders, by moving each of the plurality of drive pistons toward the second ends of the respective ones of the plurality of sealed cylinders; and transmitting thermal energy from the second quantities of working fluid in the second annular gaps to a third flow of heat transfer fluid by passing the third flow of heat transfer fluid over the second ends of the sealed cylinders, and, simultaneously with said transmitting of thermal energy from the second quantities of working fluid in the second annular gaps to the third flow of heat transfer fluid, transmitting thermal energy from a fourth flow of heat transfer fluid to the first quantities of working fluid by passing the fourth flow of heat transfer fluid over the first ends of the sealed cylinders; and applying a motive force to each of the plurality of drive pistons via regions of transverse magnetic flux;

wherein each of the plurality of drive pistons has coupled thereto a respective plurality of permanent magnets with poles arranged in alternating polar orientation such that adjacent magnets are positioned with like poles facing each other, and wherein the moving each of the plurality of drive pistons toward the first ends of respective ones of the plurality of sealed cylinders comprises applying a motive force to each of the plurality of drive pistons via regions of transverse magnetic flux supported by the respective plurality of permanent magnets; and wherein each of the plurality of sealed cylinders has, arranged concentrically thereto, a respective electromagnetic coil arranged to magnetically couple to the respective plurality of magnets via the regions of transverse magnetic flux, and wherein the applying a motive force to each of the plurality of drive pistons comprises driving electrical current through each respective one of a plurality of the electromagnetic coils.

12. The method of claim 11, wherein the applying a motive force to each of the plurality of drive pistons via regions of transverse magnetic flux comprises generating electromagnetic fields by applying a voltage to each of the plurality of electromagnetic coils positioned around respective ones of the plurality of sealed cylinders.

13. The method of claim 12, wherein the generating electromagnetic fields by applying a voltage to each of the plurality of electric coils comprises selecting a polarity of the applied voltage according to an intended direction of movement of each of the plurality of drive pistons.

14. The method of claim 11, comprising:

prior to the passing the first flow of heat transfer fluid over the first ends of the sealed cylinders, transmitting thermal energy from a thermal load to the first flow of heat transfer fluid;

following the passing the first flow of heat transfer fluid over the first ends of the sealed cylinders, transmitting thermal energy from the first flow of heat transfer fluid to a heat sink;

prior to the passing the second flow of heat transfer fluid over the second ends of the sealed cylinders, transmitting thermal energy from the second flow of heat transfer fluid to the heat sink; and following the passing the second flow of heat transfer fluid over the second ends of the sealed cylinders, transmitting thermal energy from the thermal load to the second flow of heat transfer fluid.

15. The method of claim 14, comprising:

prior to the passing the third flow of heat transfer fluid over the second ends of the sealed cylinders, transmitting thermal energy from the thermal load to the third flow of heat transfer fluid;

following the passing the third flow of heat transfer fluid over the second ends of the sealed cylinders, transmitting thermal energy from the third flow of heat transfer fluid to the heat sink;

prior to the passing the fourth flow of heat transfer fluid over the first ends of the sealed cylinders, transmitting thermal energy from the fourth flow of heat transfer fluid to the heat sink; and following the passing the fourth flow of heat transfer fluid over the first ends of the sealed cylinders, transmitting thermal energy from the thermal load to the fourth flow of heat transfer fluid.

16. The method of claim 11, wherein the first, second, third, and fourth flows of heat transfer fluid are comingled portions of a volume of heat transfer fluid flowing in a continuous fluid circuit, the method further comprising:

prior to the passing the first flow of heat transfer fluid over the first ends of the sealed cylinders and the passing the second flow of heat transfer fluid over the second ends of the sealed cylinders, initiating movement of the volume of heat transfer fluid in a first direction in the continuous fluid circuit; and prior to the passing the third flow of heat transfer fluid over the second ends of the sealed cylinders and the passing the fourth flow of heat transfer fluid over the first ends of the sealed cylinders, initiating movement of the volume of heat transfer fluid in a second direction, opposite the first direction, in the continuous fluid circuit.

17. The method of claim 11, wherein performing the steps of claim 11 comprises performing the steps in the recited order, the method further comprising, following the passing the third flow of heat transfer fluid over the second ends of the sealed cylinders and simultaneously passing the fourth flow of heat transfer fluid over the first ends of the sealed cylinders, continuously repeating the steps of claim 11 in the recited order.

18. The active gas regenerative refrigerator of claim 1, further comprising a magnetic coupler configured to concentrate magnetic flux of at least one of the transverse magnetic flux regions of the plurality of permanent magnets, the magnetic coupler being disposed between a first magnet and a second magnet of the plurality of permanent magnets and having a diameter that is larger than a diameter of the first magnet, larger than a diameter of the second magnet, and that is approximately the same as an inside diameter of the main cylinder between the first cylinder end and the second cylinder end such that the magnetic coupler is axially movable along the main cylinder with the plurality of permanent magnets of the drive piston.

19. The method of claim 11, wherein at least a first magnet and a second magnet of the plurality of permanent magnets are separated only by a magnetic coupler, the magnetic coupler configured to concentrate magnetic flux of at least one of the transverse magnetic flux regions of the plurality of permanent magnets.

20. The active gas regenerative refrigerator of claim 1, wherein the seal comprising polytetrafluoroethylene comprises Rulon.

21. The active gas regenerative refrigerator of claim 1, wherein the seal comprising polytetrafluoroethylene comprises Teflon.

22. The gas regenerative refrigerator of claim 1, wherein the main cylinder comprises a 0.125" outer diameter Al alloy 2024 T6 tube with 0.003" wall.

23. The gas regenerative refrigerator of claim 22, wherein the helium working gas and the cylinder wall has a Biot number on the order of $10^{-3}$.

* * * * *